United States Patent [19]

Schindler et al.

[11] Patent Number: 4,715,336

[45] Date of Patent: Dec. 29, 1987

[54] FOUR-STROKE INTERNAL COMBUSTION PISTON ENGINE

[75] Inventors: Manfred Schindler, Markt Schwaben; Reinhold Ficht, Munich, both of Fed. Rep. of Germany

[73] Assignee: Ficht GmbH

[21] Appl. No.: 833,814

[22] Filed: Feb. 26, 1986

[30] Foreign Application Priority Data

Feb. 28, 1985 [DE] Fed. Rep. of Germany ..... 3507108

[51] Int. Cl.[4] ..... F02B 75/24

[52] U.S. Cl. ..... 123/56 BC; 123/80 BB; 123/318

[58] Field of Search ..... 123/56 R, 56 B, 56 BC, 123/318, 80 BB

[56] References Cited

U.S. PATENT DOCUMENTS 3,517,652 6/1970 Albertson ..... 123/56 BC
4,311,119 1/1982 Menzies et al. ..... 123/80 BB

FOREIGN PATENT DOCUMENTS 2756308 6/1979 Fed. Rep. of Germany ..... 123/318

*Primary Examiner*—Craig R. Feinberg
*Attorney, Agent, or Firm*—Toren, McGeady & Associates

[57] ABSTRACT

A four-stroke internal combustion piston engine includes at least two cylinders disposed in axial alignment opposite on another. Each cylinder has a piston axially reciprocal therein with the pistons in the two cylinders operating with a phase shift of 180°. Each piston is connected by a piston rod to the same crankshaft located between the cylinders. Each piston moves between a bottom dead center at an inner end of the cylinder adjacent the crankshaft to a top dead center at an outer end of the cylinder spaced outwardly from the crankshaft. During movement of the piston from the inner end to the outer end, fresh air or a fuel-air mixture is drawn into the cylinder through a suction system and when the piston moves in the opposite direction a transfer system conveys the fresh air or fuel-air mixture into a combustion space formed between the outer end of the cylinder and the piston. Each cylinder has its own suction system and transfer system including check valves so that the supply and flow of the fresh air or fuel-air mixture is separate for each cylinder.

4 Claims, 4 Drawing Figures

FOUR-STROKE INTERNAL COMBUSTION PISTON ENGINE

BACKGROUND OF THE INVENTION

The present invention is directed to a four-stroke internal combustion piston engine with at least two axially extending cylinders each located on an opposite side of a crankshaft and extending axailly outwardly from the crankshaft. A piston is located within each cylinder and is arranged to reciprocate in the axial direction between the inner and outer ends of the cylinder with the pistons arranged to operate with a 180° phase shift. Each piston has a piston rod connecting it to the crankshaft. Each piston has a bottom dead center adjacent the inner end of the cylinder closer to the crankshaft and a top dead center adjacent the outer end of the cylinder more remote from the crankshaft. A suction system is associated with the cylinders for supplying one of fresh air or a fuel-air mixture into the inner cylinder space and a transfer system for transferring the fresh air or fuel-air mixture from the inner space to an outer cylinder space on the opposite side of the piston. When the piston moves toward the outer end it draws the fresh air or fuel-air mixture into the inner cylinder space while the other piston moves toward the inner end of the other cylinder and displaces the fresh air or fuel-air mixture through the transfer system for flow into the outer cylinder space forming a combustion chamber.

There are a number of different internal combustion piston engines with the cylinders located opposite one another and extending outwardly on the opposite sides away from a crankshaft housing. When the pistons move outwardly from the crankshaft housing they draw fresh air or fuel-air mixture into the interior of the crankshaft housing and then compress the fresh air or fuel-air mixture as the piston moves inwardly and at the same time direct the air or fuel-air mixture into a cylinder through an overflow or transfer channel.

Therefore, in the German Offenlegungsshrift No. 33 15 853 a process for operating a four-stroke motor with cylinders disposed in pairs extending opposite one another is disclosed with the pistons operating with a 180° phase shift. The pistons move in opposite directions and their reciprocating motion is converted into rotational motion by a crankshaft drive. During the simultaneous movement of both of the pistons in the outward direction, that is, toward the cylinder head, fresh air or a fuel-air mixture is drawn through an inlet check valve into the crankcase. Subsequently, during the simultaneous inward stroke, that is, as both pistons move toward the crankshaft, the air previously drawn in, is pressed out of the crankcase through a branch channel of a common overflow or transfer channel system into the combustion space of only one of the two oppositely disposed cylinders, that is, in the cylinder which executes the intake stroke while the power stroke is effected in the other cylinder. During the next crankshaft turn the air or fuel-air mixture is drawn into the crankshaft housing through the previously mentioned intake check valve by the action of the two outwardly moving pistons and then the air or fuel-air mixture is transferred into the other cylinder as the two pistons move inwardly.

This known process has disadvantages in that the charging or boosting quality for the individual cylinders is insufficient, particularly in high speed engines. This occurs as a result of the intake stroke when the two pistons are moving outwardly, the fresh air or the air-fuel mixture for a respective cylinder must initially be accelerated or moved in its entire mass by the two pistons, since before that time no noticeable compression could occur because the intake valve for the cylinder to be charged had already opened during the outward movement of the two pistons. Due to the inertia of the intake gas column which must be accelerated, certain charging losses occur which reduce the specific output of the cylinder or the so-called volumetric output. Furthermore, the fresh air or fuel-air mixture is conveyed through the interior of the crankshaft housing which is also disadvantageous.

SUMMARY OF THE INVENTION

Therefore, the primary object of the present invention is to avoid the disadvantages of the known charging process and to provide a four-stroke internal combustion engine with an intake or boosting system which considerably improves the charging capacity particularly in high speed motors and where the charging flow through the crankshaft housing is to be avoided.

In accordance with the present invention, each cylinder is provided with its own suction system for drawing in the fresh air or fuel-air mixture and with its own transfer system for conveying the fresh air or fuel-air mixture from one side of the piston to the other.

Since the suction system and the transfer system operate separately in each of the cylinders located opposite one another an improved output operation of the individual cylinders is achieved. The increase in output is based particularly on the fact that during the power stroke by the piston moving inwardly a first partial quantity of the entire air or fuel-air mixture is stored in the transfer channel of the transfer system under pressure with the help of the transfer system check valve and is immediately available for the subsequent boosting or charging of the cylinder, that is, it is located upstream flow-wise of the combustion chamber in the path of the closed cylinder inlet. With the cylinder inlet opened at the commencement of the inwardly directed stroke, the first partial quantity of the pressurized air or fuel air mixture flows very rapidly into the combustion chamber. The first partial quantity is then followed directly by a second partial quantity of fuel air or the fuel-air mixture drawn in by the piston which flows into the cylinder space during the inwardly directed stroke being displaced by the inwardly moving piston and directed through the transfer system check valve into the transfer channel. Due to the high flow velocity initiated by the precompression of the first partial quantity of the intake air or the fuel-air mixture flowing into the cylinder space, a residual suction acts upon the second partial quantity of the intake air or fuel air mixture and aids in the flow of the second partial quantity into the cylinder space. With the strong flow of the first partial quantity of the intake air or the fuel-air mixture into the cylinder space, a more intensive and more rapid mixing of the fuel and the air occurs and improves the combustion efficiency and affords a better output yield.

The construction of the slider crank motor is favorable for the boosting or charging system of the present invention, since the individual cylinders can be practically hermetically sealed with respect to the crankshaft housing or crankcase.

An internal combusion engine with two cylinders arranged opposite one another is known from the Patentschrift No. 920 758 in which the pistons are connected to one another by a slider crank and their piston rods. This arrangement deals with a two-stroke internal combustion engine where only intake valves lead into the combustion chamber and where the gas mixture is supplied through the slider crank housing common to both cylinders.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
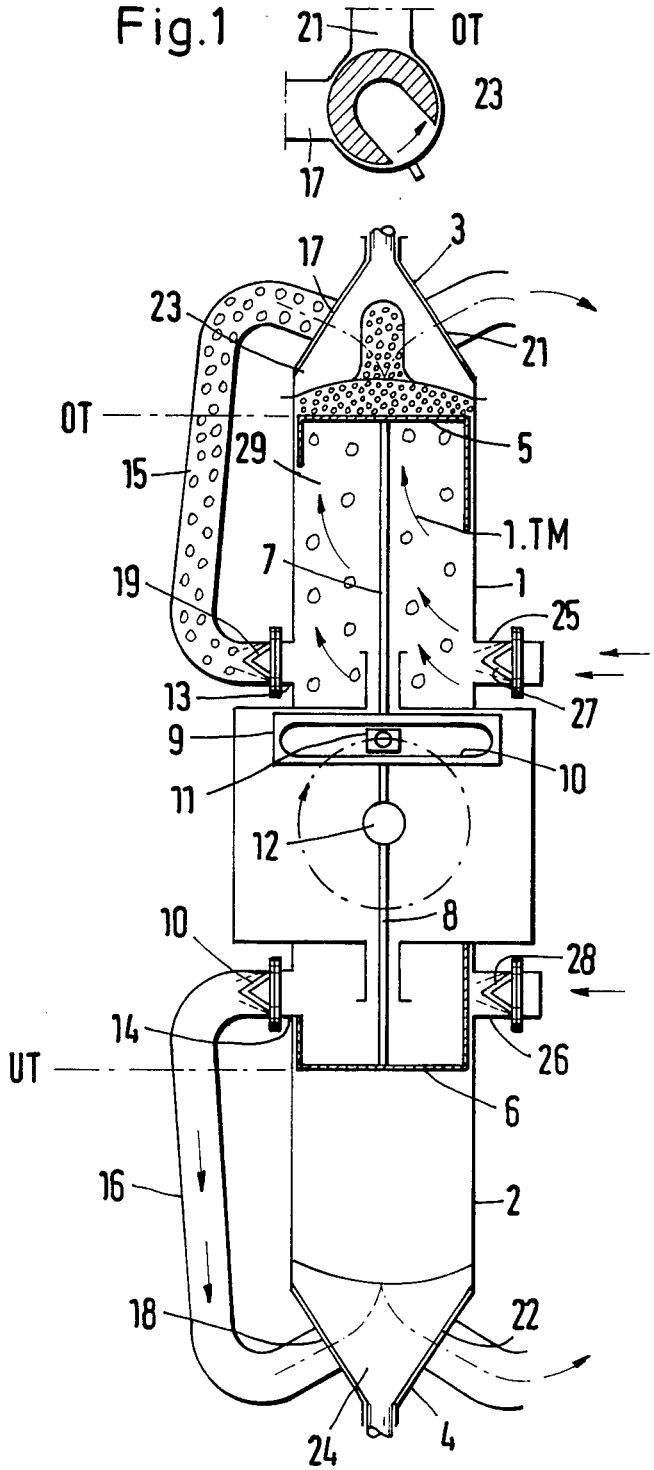
FIG. 1 is a schematic view of a four-stroke internal combustion engine with two-stroke cylinders disposed opposite one another and with the pistons operating in the same direction and interconnected via a slider crank drive with the upper piston shown in the top dead center position corresponding to stroke I.

As can be noted in FIGS. 1–4, the four-stroke internal combustion engine includes two axially extending cylinders 1, 2 axially aligned opposite one another with each cylinder having a head 3, 4 located at the end of the cylinder more remote from the other cylinder. Each cylinder 1, 2 has a piston 5, 6 and the pistons are rigidly coupled together by piston rods 7, 8 disposed in the axial direction of the cylinders and with a slider crank frame 9 connected to the ends of the piston rods spaced from the pistons. The slider crank frame includes a guide link 10 with a slider block 11 moving in the link and engaged to the crank web of a crankshaft 12. The crankshaft 12 is spaced between the two cylinders and is enclosed by a housing. The cylinders are sealed from the crankshaft housing.

As viewed in FIGS. 1–4 each cylinder has an inner end adjacent the crankshaft 12 and an outer end spaced outwardly from the crankshaft, that is, at the cylinder heads 3, 4. As described herein the pistons move inwardly from the cylinder heads toward the crankshaft and outwardly from the inner end adjacent the crankshaft toward the cylinder heads.

At the inner end of each cylinder 1, 2 there is a transfer channel 15, 16 connected at the inner end to a transfer tube stub 13, 14 and extending outwardly generally in the axial direction of the cylinder and exteriorly of the cylinder to a cylinder inlet 17, 18. Each transfer channel 15, 16 is controlled adjacent the inner end by a transfer check valve 19, 20 which opens into the channel 15, 16 and blocks flow in the reverse direction. The outer end or cylinder head inlets 17, 18 and the outlets 21, 22 from the cylinder head are controlled by a rotary slide valve 23, 24. Furthermore, suction stubs 25, 26 are arranged at the inner end of the cylinders 1, 2 on the opposite side of the cylinders from the transfer tube stubs 13, 14. The suction stubs serve for the flow of fresh air or a fuel-air mixture into the cylinder. An inlet check valve 27, 28 is located in each of the suction stubs 25, 26. Known diaphragm valves serve as the check valves. The space within each cylinder is divided into an inner space located between the piston and the inner end of the cylinder and an outer space located between the piston and the cylinder head. These spaces are variable in volume depending on the location of the piston.

Figure 2:
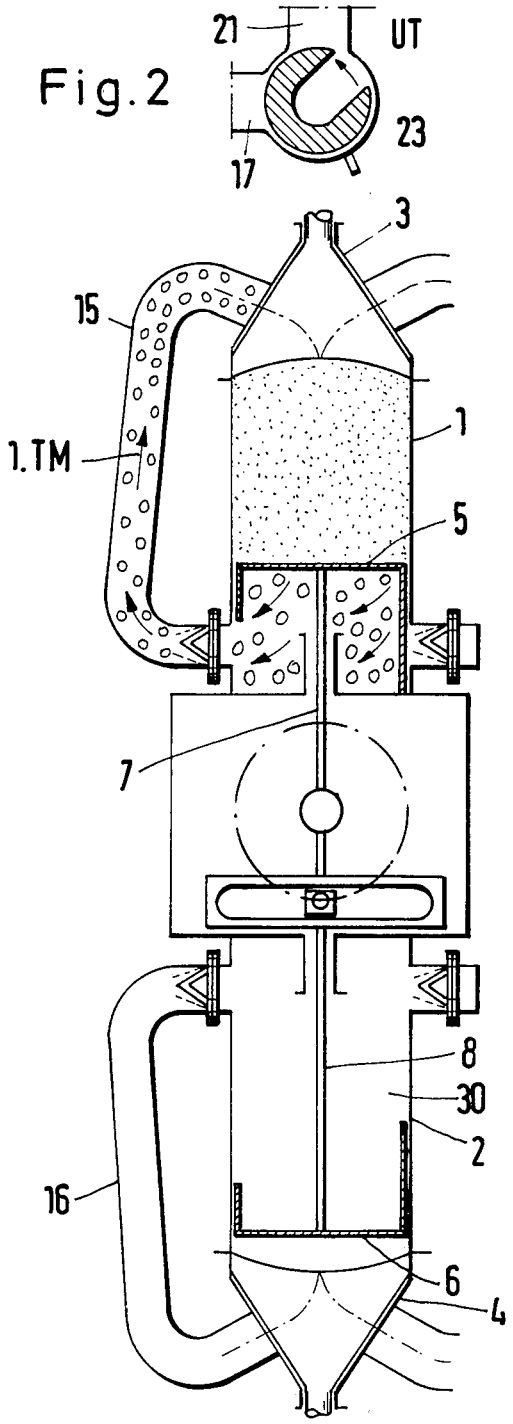
FIGS. 2–4 are schematic views of the two cylinder arrangement shown in FIG. 1 during the different engine strokes II–IV.
Figure 3:
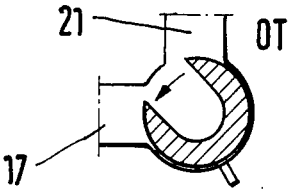
Figure 3:
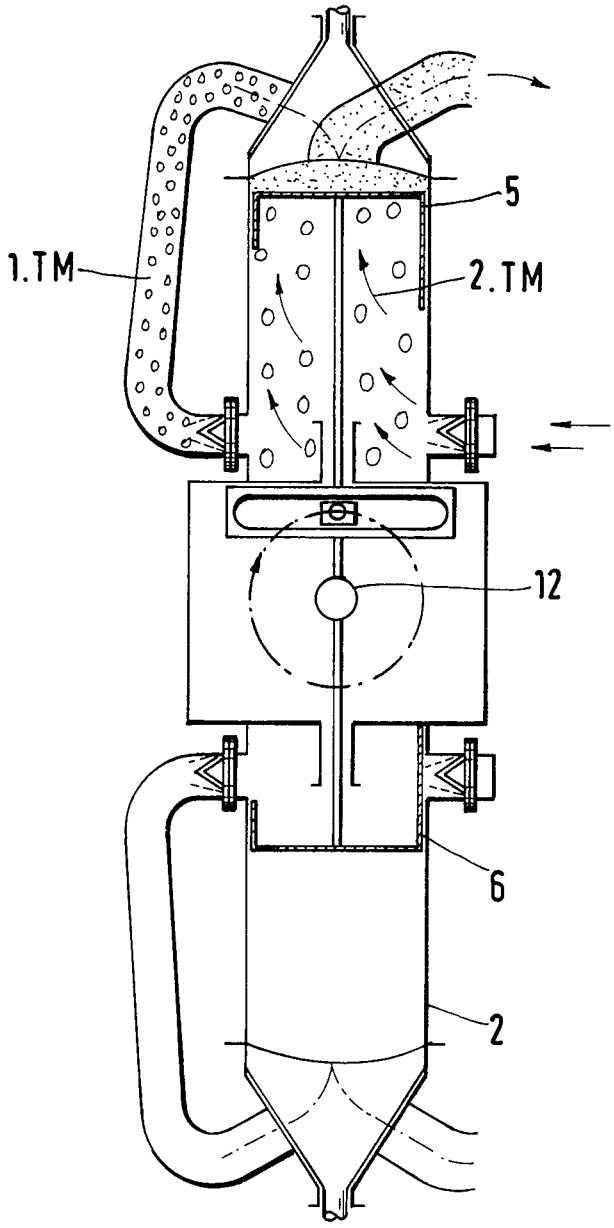

The illustrated two-stroke internal combustion piston engine operates on a four-stroke cycle in the following manner:

In FIG. 1, the piston 5 has just finished the compression stroke in the cylinder 1, that is, the compression within the outer cylinder space, and is located at the top dead center OT, with the crankshaft and the rotary slide valve being in the zero degree position. During the compression stroke the piston has at the same time drawn fresh air (intake air) or a fuel-air mixture through the suction stub 25 and the check valve 27 into the inner cylinder space 29. The rotary slide valve 23, during the operation described above, closes the cylinder head inlet 17 and the cylinder head outlet 21 in the cylinder head 3. Shortly before the piston 5 reaches top dead center, ignition occurs in the usual manner and combustion of the fuel-air mixture is commenced. Due to the increasing pressure of the combustion gases, piston 5 is moved inwardly to the bottom dead center UT and the crankshaft has turned through 180° and the rotary slide valve 23 through 90°, note the position of the rotary slide 23 shown at the upper end of each of FIGS. 1–4. The piston presses the fresh air or the fuel-air mixture located in the inner cylinder space 29 through the transfer check valve 19 into the transfer channel 15 on the exterior of the cylinder 1. This quantity of fresh air or fuel-air mixture is designated as the first partial quantity (1.TM), note FIG. 2, of the entire quantity of fresh air or of the fuel-air mixture for the complete charging or boosting of one cylinder (one cylinder charge) (FIGS. 1 and 2). This first partial quantity (1.TM) of fresh air or fuel-air mixture remains stored in the precompressed state in the transfer channel 15 during the subsequent exhaust stroke where the piston 5 moves toward the top dead center OT with crankshaft rotation of 360° and the rotary valve rotation of 180°, note FIG. 3. To obtain the precompression of this first partial amount, the transfer channel 15 (also the transfer channel 16) has a volume smaller than the volume of the inner cylinder space 29 of the cylinder 1 and of the inner cylinder space 30 of the cylinder 2. During the exhaust stroke the second partial amount (2.TM) of fresh air or intake air or of the fuel-air mixture is drawn through the suction stub 28 and the check valve 27 by the suction developed in the inner cylinder space 29 (FIG. 3).

Figure 4:
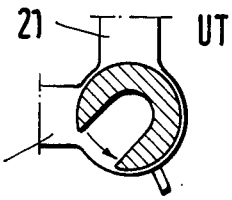
Figure 4:
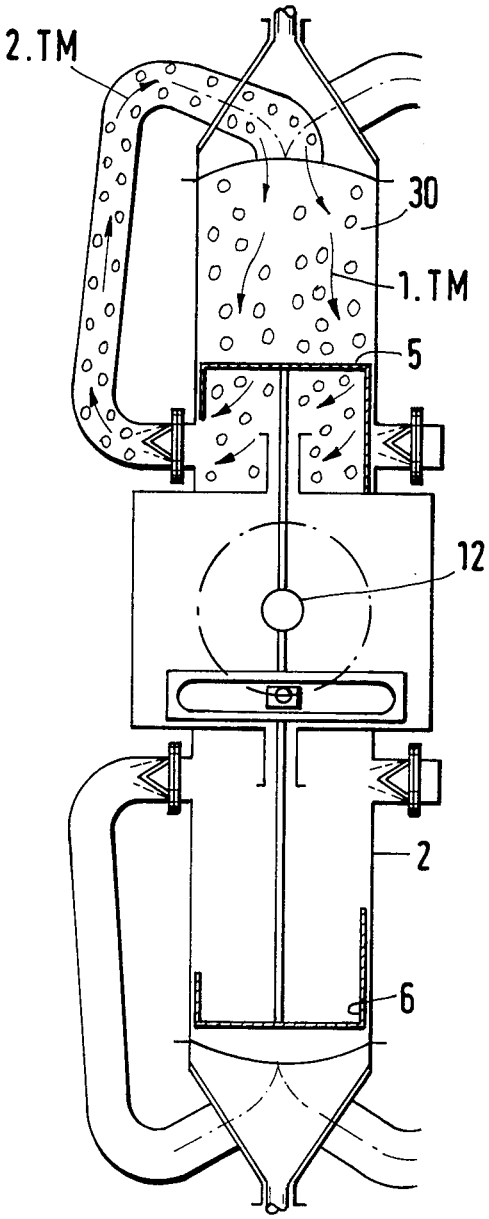

Next the suction stroke takes place, note FIG. 4, with the piston moving toward the top dead center position and the crankshaft having rotated through 540° and the rotary slide valve having rotated through 270°. In this position the cylinder head inlet 17 is opened by the rotary slide valve 23. The first partial amount (1.TM) of the intake air or of the fuel-air mixture stored under pressure in the transfer channel 15 flows immediately due to its pressurization into the combustion chamber 30. The first partial amount is immediately followed by the second partial amount (2.TM) of the intake air or fuel-air mixture displaced by the piston 5 moving inwardly and flowing through the transfer check valve 19 into and through the transfer channel 15, note FIG. 4, with the crankshaft rotation having reached 720°, that is, again at zero degrees, and the rotary slide valve having executed rotation through 360°, that is, having returned to the zero degree position.

The cylinder 2 operates along with its piston 6 offset phase-wise by 180° in relation to the operation of the cylinder 1 and its piston 5, as can be noted from the illustration of the operation of the pistons shown in the drawing.

While specific embodiments of the invention have been shown and described in detail to illustrate the application of the inventive principles, it will be understood that the invention may be embodied otherwise without departing from such principles.

We claim:

1. Four-stroke internal combustion piston engine comprising a crankshaft housing, a crankshaft located within said housing, at least two axially extending cylinders each located on an opposite side of said housing from one another and extending axially outwardly from said housing, each said cylinder having an inner end adjacent said housing and an outer end spaced axially outwardly from said housing, a piston located within each said cylinder and arranged to reciprocate in the axial direction of said cylinder between the inner and outer ends thereof, said pistons arranged to operate with a 180° phase shift, an axially extending piston rod for each said piston connected at one end to said piston and at the other end to said crankshaft, each said piston having a bottom dead center adjacent the inner end of said cylinder and a top dead center adjacent the outer end of said cylinder, each said cylinder having a variable volume inner cylinder space located between said piston and the inner end of said cylinder and a variable volume outer cylinder space located between said piston and the outer end of said cylinder, a suction system associated with said cylinders for supplying one of fresh air and a fuel-air mixture into said inner cylinder space, said suction system including means for transferring the one of fresh air and fuel-air mixture from said inner cylinder space to said outer cylinder space of said cylinder so that said piston moving toward said outer end draws the one of fresh air and fuel-air mixture into said inner cylinder space while the other said piston moves toward the inner end of the other said cylinder and displaces the one of fresh air and fuel-air mixture via said transfer means from said inner space for subsequent flow into said outer cylinder space forming a combustion chamber, wherein the improvement comprises that said suction system for supplying the one of fresh air and fuel-air mixture comprises a separate suction system section for supplying the one of fresh air and fuel-air mixture into each of said cylinders, said transfer means in each said supply system section comprises a transfer channel located exteriorly of said cylinder and connected at one end adjacent the inner end of said cylinder and at an opposite end above the cylinder adjacent the outer end of said cylinder, a transfer check valve located in said transfer channel at the inner end of said cylinder, and a suction stub located at the inner end of said cylinder spaced from said transfer channel and including an inflow check valve, said outer end of each cylinder has an outlet therein spaced from an inlet from said transfer channel into the outer end of said cylinder, a rotary slide valve located within the outer end of each said cylinder for controlling inflow from said transfer channel and flow through said outlet.

2. Four-stroke internal combustion piston engine, as set forth in claim 1, wherein each said transfer channel has a storage volume, each said inner cylinder space has a piston displacement volume and said storage volume is smaller than the piston displacement volume.

3. Four-stroke internal combustion piston engine, as set forth in claim 1, wherein said check valves in the connection of the end of said transfer channel to the inner end of said cylinder and in said suction stub are diaphragm valves.

4. Four-stroke internal combustion piston engine, as set forth in claim 1, wherein said inner cylinder spaces of said cylinder are sealed with respect to said crankshaft housing.

* * * * *